US006254362B1

(12) United States Patent
Higuchi et al.

(10) Patent No.: US 6,254,362 B1
(45) Date of Patent: Jul. 3, 2001

(54) VACUUM PUMP WITH DUST COLLECTING FUNCTION

(75) Inventors: Tsutomu Higuchi, Yokohama; Shigeharu Kambe, Kawasaki, both of (JP)

(73) Assignee: Unozawa-Gumi Iron Works, Ltd., Tokyo (JP)

( * ) Notice: Subject to any disclaimer, the term of this patent is extended or adjusted under 35 U.S.C. 154(b) by 0 days.

(21) Appl. No.: 09/129,005

(22) Filed: Aug. 4, 1998

(30) Foreign Application Priority Data

Jan. 26, 1998 (JP) ..... 10-012621

(51) Int. Cl.[7] ..... F04B 17/00
(52) U.S. Cl. ..... 417/423.9; 417/279
(58) Field of Search ..... 417/279, 423.9, 417/313, 440

(56) References Cited

U.S. PATENT DOCUMENTS 4,311,025 * 1/1982 Rice ..... 62/502
4,401,507 * 8/1983 Engle ..... 156/643
4,621,985 * 11/1986 Kobayashi et al. ..... 417/250
4,897,115 * 1/1990 Van Wijk ..... 75/63
4,969,934 * 11/1990 Kusilk et al. ..... 55/1
4,995,794 * 2/1991 Wycliffe ..... 417/431

FOREIGN PATENT DOCUMENTS 0 338 764 A2 10/1989 (EP) .
2 691 832 11/1993 (EP) .
59-39800 5/1984 (JP) .
61-97187 5/1986 (JP) .
2-70990 3/1990 (JP) .

* cited by examiner

*Primary Examiner*—Henry C. Yuen
*Assistant Examiner*—Mahmoud Gimie
(74) *Attorney, Agent, or Firm*—Merchant & Gould P.C.

(57) ABSTRACT

A vacuum pump with dust collecting function is proposed to deal with the case where dust produced by a process of productions by reaction in a processing vessel under vacuum may to enter a vacuum pump. During evacuation of a processing vessel by a vacuum pump, an auxiliary dust collecting path is closed by a shut-off valve and evacuation through a main exhaust path is carried out. During a period in which evacuation by the vacuum pump is not necessary, the auxiliary dust collecting path is open to form a circulation path with the main exhaust path to carry out collection of the dust by a dust separator.

7 Claims, 5 Drawing Sheets

VACUUM PUMP WITH DUST COLLECTING FUNCTION

BACKGROUND OF THE INVENTION

1. Field of the Invention

The present invention relates to a vacuum pump with a dust collecting function for use when a vessel for a process, in which various processes of productions by reaction or melting and crystallization processes are carried out under a reduced pressure atmosphere evacuated by a vacuum pump, is used. The process may be a process of epitaxial growth for producing monocrystalline film of silicon, in which an amount of dust is produced when the reaction process or a melting and crystallization process take place and the produced dust flows into the vacuum pump together with the existing gas.

2. Description of the Related Arts In general, the process of productions by reaction and the melting and crystallization processes in a vessel for processing under a reduced pressure are carried out in vacuum. Therefore, the specific gravity of the gas which flows into a vacuum pump is very small. When the gas, together with the dust, flows into the vacuum pump, the gas flows appropriately but has less ability to convey the dust, and therefore a greater portion of the dust is accumulated in the vacuum pump. In prior arts, the increased amount of the accumulated dust prevents the satisfactory running of the vacuum pump to cause difficulty in continuing the running of the vacuum pump so that frequent operations to remove the dust in the vacuum pump are needed.

Also, there is a problem that, if the sizes of grains of the dust which flows together with the gas into the vacuum pump are large, the internal structures of the vacuum pump, such as rotors, collect the grains of the dust to which can lead to a failure or a stoppage of the vacuum pump.

To prevent dust from flowing into the vacuum pump attempts have been made to separate the dust by providing filters or the like between the vacuum pump and the dust producing device. There is a problem, however, in that the dust causes blocking of the through-paths in the filter which are then greatly reduced. The effective evacuation performance of the vacuum pump for the process of production by reaction and the melting and crystallization in the vessel for processing prevent the reaction process and the melting and crystallization in the vessel for processing from continuing.

It is possible to provide a dust separator for separating dust utilizing the flow of gas, such as a cyclone type separator, between the vacuum pump and the vessel for processing. However, in this case, to reduce the loss of the pressure by the cyclone type separator, if the cross-sectional area of the gas flow in the separator is increased, no sufficient gas flow velocity is obtained so that the satisfactory separation of the dust cannot be realized in the cyclone type separator. Since the process is carried out under high degree of vacuum in the vessel for processing, the amount of the flow of the gas entering into the vessel, coming out from the vessel and being sent to the vacuum pump is relatively small. Therefore, the ability of the vacuum pump to transfer the dust to discharge the dust is low, and accordingly the dust tends to be accumulated in the vacuum pump to lead to a stoppage of the vacuum pump.

Since the dust is discharged together with the gas from the vacuum pump, a large amount of dust flows into the exhaust gas processing system. Therefore, there is a problem that the exhaust gas processing system is quickly contaminated and this prevents the functioning of the system.

SUMMARY OF THE INVENTION

It is an object of the present invention to solve the above described problems by providing an appropriate vacuum pump with a dust collecting function.

According to the present invention, there is provided a vacuum pump with a dust collecting function comprising: a vessel for processing which can be decompressed by a vacuum pump; suction piping connected to said processing vessel; a vacuum pump operatively connected to said suction piping; vacuum pump piping adapted to constitute a main exhaust operation path including the vacuum pump for exhausting gas and an auxiliary dust collecting circulation path including the vacuum pump for collecting dust; gas discharge piping; and a dust separator connected directly to the vacuum pump in the main exhaust operation path; wherein, during the exhaust period, the auxiliary dust collecting circulation path is shut to allow exhaust through the main exhaust operating path to be carried out, and, during the period in which the decompression by the vacuum pump is not necessary, the auxiliary dust collecting circulation path is formed to constitute a circulation path together with the main exhaust operation path to carry out the dust.

The dust separator may be is connected directly to the vacuum pump in the main exhaust operation path.

A shut-off valve for opening and closing the auxiliary dust collecting path may be inserted in the auxiliary dust collecting path.

A gas diffusing liquid chamber may be inserted in the gas discharge piping.

In a vacuum pump with a dust collecting function according to the present invention, decompression of a vacuum pump is carried out, and, during the reaction process or the melting and crystallization in the processing vessel, the shut-off valve in the auxiliary dust collecting path is closed, and the gas exhausted from the processing vessel flows together with the dust into the vacuum pump. The gas is exhausted by the vacuum pump, and the exhaust gas as is discharged from the vacuum pump through the exhaust piping which leads to the exhaust gas processing system or the discharge outlet. Since the processing in the processing vessel is carried out under a high degree of vacuum and therefore the specific gravity of the gas exhausted from the processing vessel is very small, the vacuum pump is not able to satisfactorily convey the dust from the vacuum pump and, accordingly, the dust is progressively accumulated in the vacuum pump. After that, when the process of productions by reaction or the melting and crystallization process in the processing vessel is completed when decompression by the vacuum pump is no longer necessary, the shut-off valve in the auxiliary dust collecting path is opened. Upon opening the shut-off valve, the suction piping and the exhaust piping of the vacuum vessel communicate with each other, and a large amount of gas which is exhausted from the vacuum pump circulates through the auxiliary dust collecting path, the dust separator, the shut-off valve, and the vacuum pump. Since the loss of pressure due to the circulation of the gas is small and the difference between the suction pressure and the discharge pressure is small, the flow rate of the circulating gas is approximate to the flow rate corresponding to the maximum exhaust rate. Therefore, the flow rate of the circulating gas is great and the specific gravity of the gas is far greater than that under the high degree of vacuum, which produces a very high capability of conveying out the dust. The dust accumulated in the vacuum pump is appropriately conveyed out to a dust separator, such as a cyclone type dust separator. The dust is separated and collected at high efficiency in the dust separator. Since the dust accumulated in the vacuum pump is discharged, the subsequent reaction process or the melting and crystallization in the processing vessel can be satisfactorily carried out.

A check valve may be provided in the exhaust piping which passes the gas exhausted from the vacuum pump to the exhaust outlet at a location downstream of the diverging point of the auxiliary dust collecting path and the exhaust piping. Also, a sealed liquid chamber having the structure to diffuse the gas into a liquid may be provided downstream of the check valve. In such arrangements, the gas containing the dust exhausted from the vacuum flows from the exhaust piping through the check valve into the sealed liquid chamber. In the liquid chamber the gas is diffused into the liquid, the dust contained in the gas is caught by the liquid due to the viscosity thereof, and only the gas flows through the exhaust piping into the exhaust gas processing system. By this operation, it is possible to avoid the prevention of the function due to the contamination of the exhaust gas processing system by the dust caused by the flow of dust into the exhaust gas processing system. Since the exhaust gas contains a small amount of dust, the exhaust gas is easily processed, and is easily collected. The check valve prevents the liquid in the liquid chamber from being sent back toward the vacuum pump when the vacuum pump is not in operation.

DETAILED DESCRIPTION OF THE PREFERRED EMBODIMENTS

Figure 1:
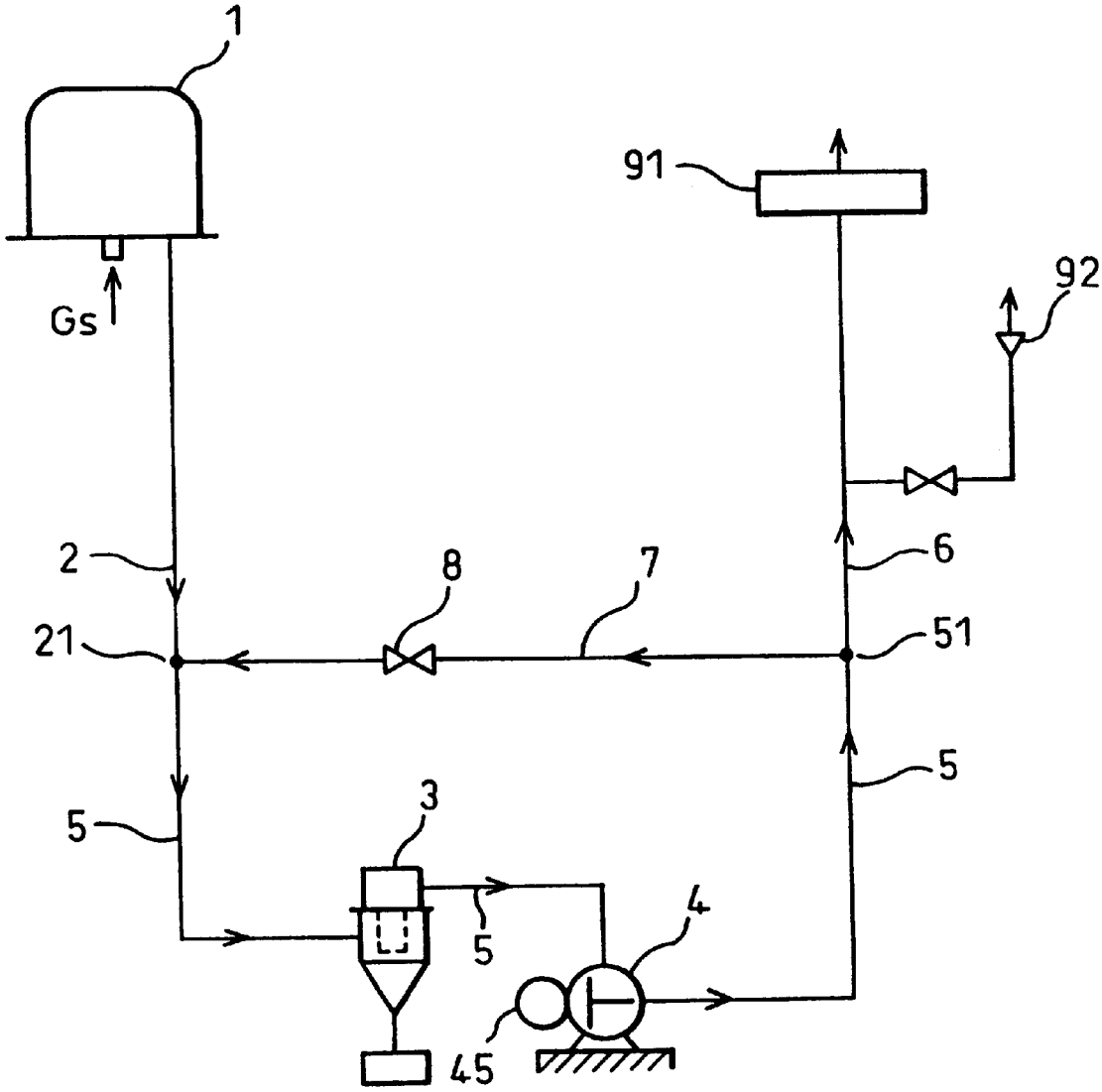
FIG. 1 shows a vacuum pump with a dust collecting function according to another embodiment of the present invention.

A vacuum pump with a dust collecting function according to the present invention is shown in FIG. 1. In the vacuum pump of FIG. 1, the processing vessel 1 decompressed by the vacuum pump 4 is connected through suction piping 4 to the junction 21. The vacuum pump 4 is driven by the motor 45. The junction 21 is connected through the main exhaust path 5 to the dust separator 3 and the vacuum pump 4. The discharge piping 6 is connected at the junction 51 with the main exhaust path 5 for leading the gas discharged from the vacuum pump 4 to the exhaust gas processing system 91 or the exhaust outlet 92. The auxiliary dust collecting path 7 is arranged in parallel with the main exhaust path 5 between the junction 21 and the junction 51. The shut-off valve 8 is arranged in the auxiliary dust collecting path 7.

The vacuum pump shown in FIG. 1 operates as follows. When the process of productions by reaction or the melting and crystallization is carried out in the processing vessel 1, the shut-off valve 8 in the auxiliary dust collecting path is closed. The gas exhausted from the processing vessel 1 is fed through the suction piping 2 and the main exhaust path 5 to a cyclone type separator 3 utilizing the function of centrifugal force, in which the dust having a relatively large grain size is separated. The dust which is not separated by the cyclone type dust separator 3 flows together with the gas into the vacuum pump 4. Since grains of relatively great size do not flow into the vacuum pump, the running of the vacuum pump is not degraded by the collection of dust by the rotors of the vacuum pump.

The gas is driven out under pressure from the vacuum pump 4, passes through the main exhausted path 5 and the discharge piping 6, and is discharged to the exhaust gas processing system 91 or the exhaust outlet 92. Since the operation in the processing vessel 1 is carried out under high vacuum, the specific gravity of the gas exhausted from the processing vessel 1 is small, the ability to convey out the dust from the vacuum pump is, therefore, not sufficient, and accordingly the dust is accumulated progressively in the vacuum pump.

When the process of productions by reaction or the melting and crystallization in the processing vessel 1 is completed and the decompression by the vacuum pump 4 becomes no longer necessary, the shut-off valve 8 in the auxiliary dust collecting path 7 is opened. The main exhaust path 5 of the vacuum pump 4 communicates through the auxiliary exhaust gas 7 with the discharge piping 5, and the large amount of gas exhausted from the vacuum pump 4 is caused to circulate through the main exhaust path 5, the junction 51, the auxiliary dust collecting path 7, the shut-off valve 8, the suction piping 2, the main exhaust path cyclone type dust separator 3, and the vacuum pump 4.

Since the loss of pressure due to the circulation of the gas is small, and the difference between the suction pressure and the discharge pressure is small, the flow rate of the circulating gas is approximately the maximum exhaust flow rate. Thus, the flow rate of the circulating gas is great, and the specific gravity of the circulating gas is far greater than the specific gravity under high vacuum. Accordingly both the flow rate and the flow velocity of the gas become great.

The dust accumulated in the vacuum pump 4 due to the circulation of the gas is conveyed out to a cyclone type separator 3 utilizing the function of centrifugal force in which the separation and the collection of the dust are carried out efficiently. Accordingly, the dust accumulated in the vacuum pump is discharged, so that the next stage process of production by reaction or melting and crystallization in the processing vessel can be satisfactorily carried out.

Figure 2:
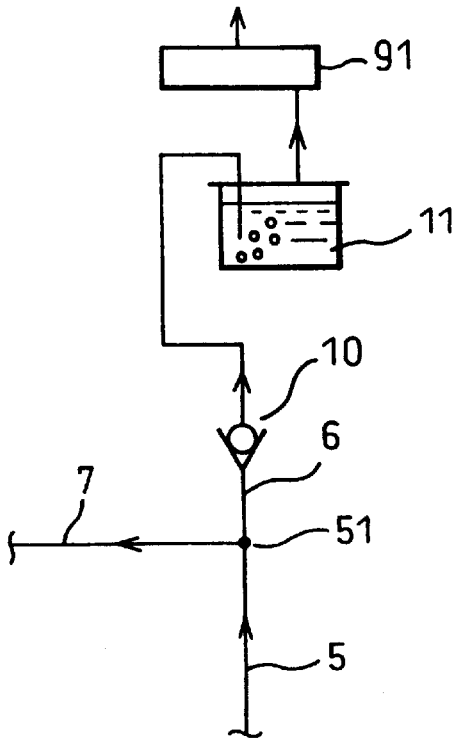
FIG. 2 shows a dust trap and an exhaust gas processing system to be applied to a vacuum pump according to an embodiment of the present invention.

As shown in FIG. 2, it is possible to arrange the check valve 10 in the discharge piping 6 connected at the junction 51 to the main exhaust path 5 and the auxiliary dust collecting path 7, and the gas diffusing sealed liquid chamber 11 having the structure to diffuse the gas into liquid in the discharge piping 6 on the side of the exhaust gas processing system 91.

The gas containing the dust discharged from the vacuum pump 4 flows through the main exhaust path 5, the junction 51, the discharge piping 6, and the check valve 10 into the sealed liquid chamber 11. The gas is bubbled into the liquid in the liquid chamber and the dust contained in the gas is caught by the viscous liquid, and only the gas passes through the piping to flow into the exhaust gas processing system 91.

By such an operation, the function of the exhaust gas processing system 91 is protected from the problem that the system is contaminated by the dust flowing into the system. Since little dust is contained in the exhaust gas, the exhaust gas can be processed and collected easily. The check valve 10 prevents the liquid in the liquid chamber from flowing back to the vacuum pump 4 when the vacuum pump is not being operated.

Figure 3:
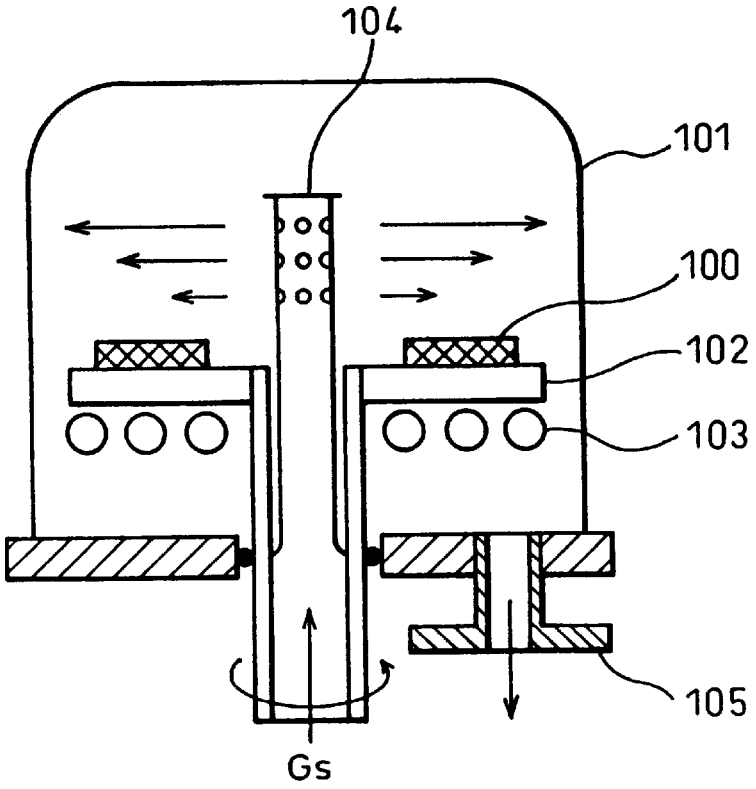
FIG. 3 shows an eptitaxial growth device as an example of a processing vessel used in a vacuum pump according to an embodiment of the present invention.

As an example of the decompressed processing vessel in the vacuum pump with a dust collecting function according to the present invention, an epitaxial growth device is shown in FIG. 3. The epitaxial growth device of FIG. 3 is used for a process to grow a monocrystalline layer of silicon on a silicon monocrystalline wafer. A silicon wafer 100 is placed on a disk type susceptor 102 of graphite placed horizontally in a bell jar 101 of quartz, generally called a vertical furnace, shown in FIG. 3, and is heated at high frequency by a spiral coil 103 from the bottom of the susceptor 102. The susceptor 102 is rotatable to make the temperature distribution uniform. The supplied gas Gs containing a material gas such as $SiH_4$ and the carrier gas such as hydrogen are charged into the bell jar 101 through the nozzle 104 from the center of the susceptor 102. Due to the thermal decomposition of $SiH_4$, silicon monocrystalline layer is grown on the silicon wafer 100, and the exhaust is carried out through the bottom outlet 105. The gas exhausted through the bottom outlet 105 contains a considerable amount of silicon dust which flows into the vacuum pump. It is required, in the vacuum pump with a dust collecting function according to the present invention, to deal with this problem.

Figure 4:
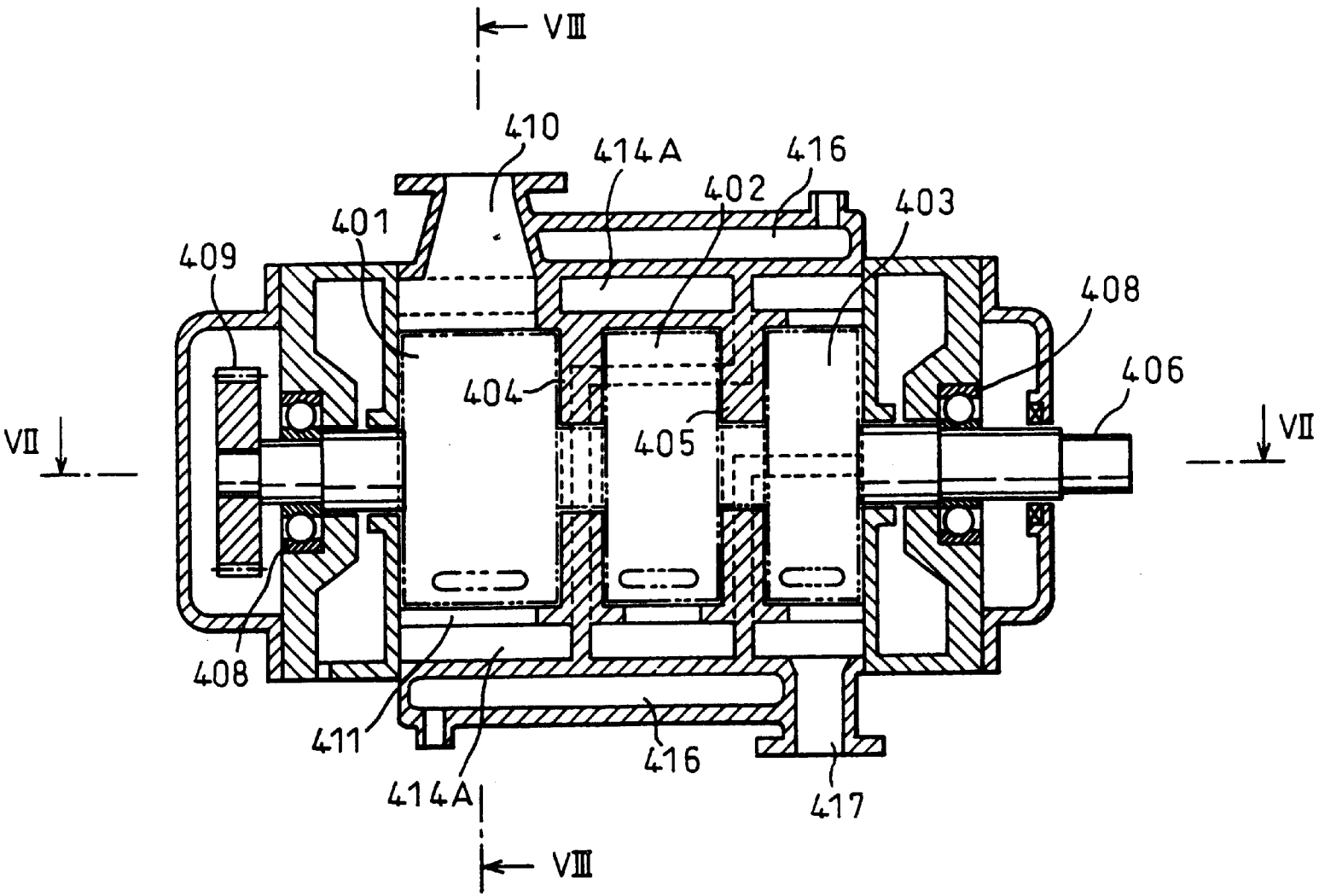
FIG. 4 shows an example of a vacuum pump.
Figure 5:
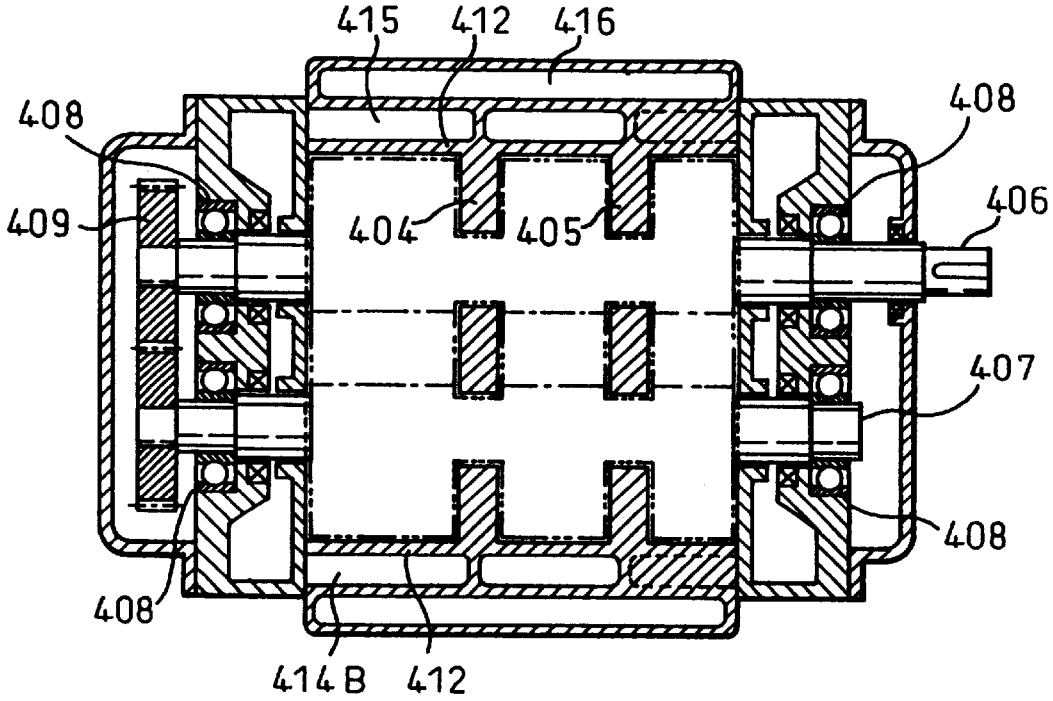
FIG. 5 is a cross-sectional view along line V—V of FIG. 4.
Figure 6:
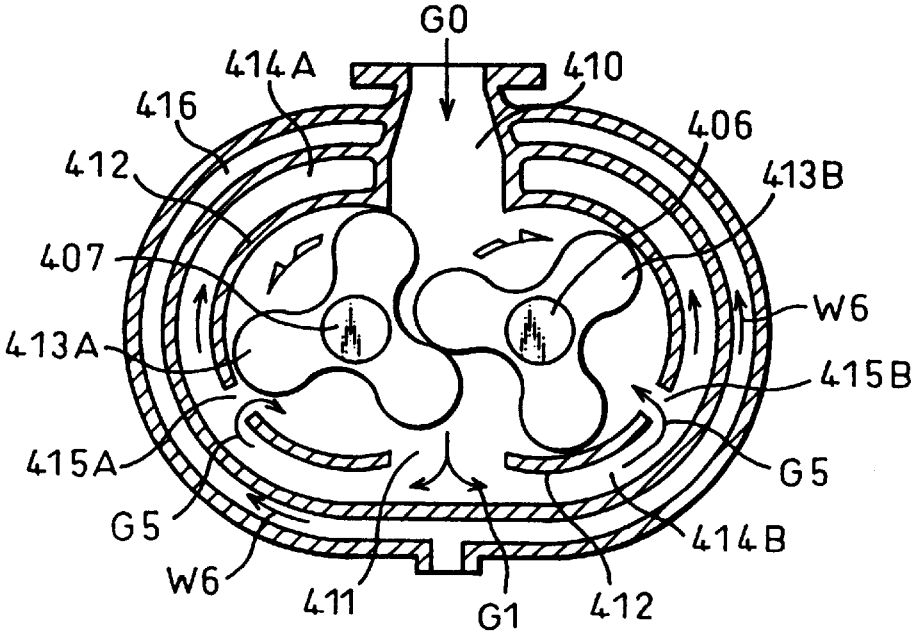
FIG. 6 is a cross-sectional view along line VI—VI of FIG. 4.

An example of the vacuum pump 4 is shown in FIGS. 4 5, and 6. Reference can be made, for example, to Japanese Patent No. 2691168 (Japanese Unexamined Patent Publication (Kokai) No. 2-70990). A reversed flow cooled 3 stage Roots type vacuum pump having a first, a second, and a third pump sections 401, 402, and 403 is shown in FIG. 4. The V—V section of FIG. 4 is shown in FIG. 5, and VI—VI section in FIG. 6.

The first pump section 401 and the second pump section 402 is partitioned by a wall 404, and the second pump section 402 and the third pump section 403 is partitioned by a wall 405.

The first shaft 406 and the second shaft 407 are supported by two bearings 408, and are rotated in opposite directions by timing gear set 409. The first shaft 406 can be driven by a motor. Each of the pump sections is constituted by a housing 412 and rotors 413A, 413B supported by a pair of shafts 406, 407. Around the circumference of the housing 412, there are circumferential gas passages 414A and 414B communicating the discharge outlet 414 and the inlets 415A and 415B for guiding the gas for the reversed flow cooling into the housing and directing it to the next stage pump section. In the circumference of the circumferential gas paths 414A, 414B, there is a cooling water passage 416.

In the vacuum pump of FIG. 4, the suction gas G0 is drawn into the housing 412 through the suction inlet 410 of each pump section, and is conveyed in accordance with the operation of the rotors 413A, 413B. During this operation, the gas is compressed in the reverse flow compression manner by the gas for the reverse flow compression which flows through the circumferential gas passages 414A, 414B and enters, through the inlets 415A, 415B for the reverse flow compression gas, into the housing, and is discharged through the discharge outlet 411, as the discharge gas G1, into the circumferential gas passages 414A, 414B.

The discharged gas flows through the external gas passage, while dissipating heat to the wall of the circumferential gas passage cooled by the water W6 flowing through the coolant water passage 416, and is divided at the inlets 415A, 415B of the reverse flow cooling gas into the reverse flow cooling gas G5 flowing again into the housing 412 and the suction gas flowing into the next stage pump section. The suction gas continues to flow in the circumferential gas passage, while dissipating heat to the wall of the circumferential gas passage cooled by water W6 flowing through the cooling water passage 416, and reaches the suction inlet of the next stage pump section. These operations are carried out successively in the sequence of pump sections, and the gas is discharged out through the discharge outlet 47 of the final third pump section 403.

Figure 7:
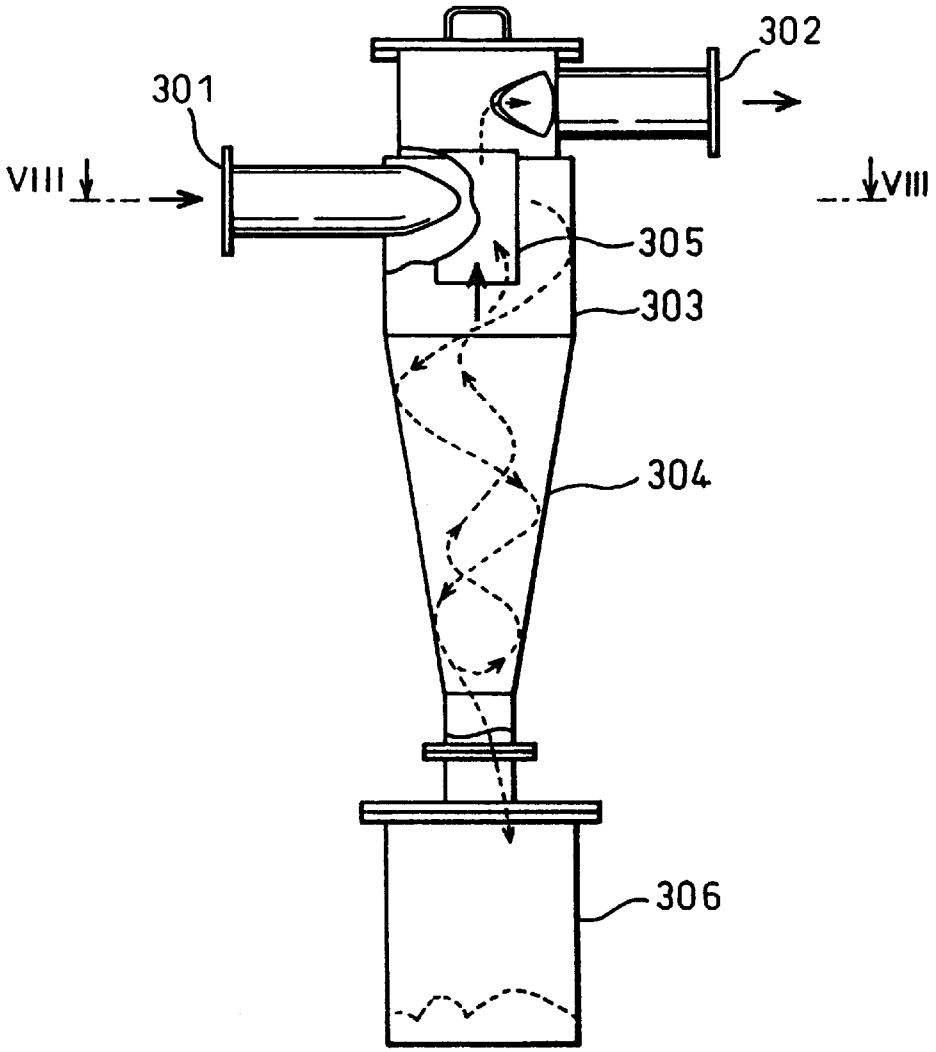
FIG. 7 shows a cyclone separator as an example of a dust separator.
Figure 8:
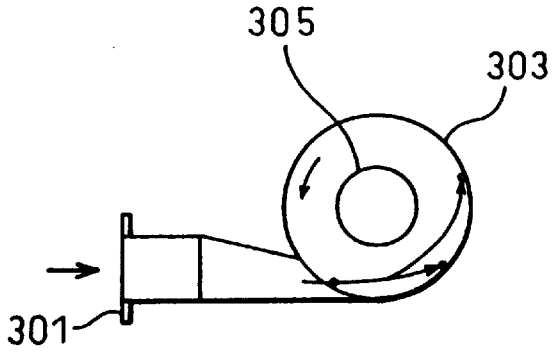
FIG. 8 is a cross-sectional view along line VIII—VIII of FIG. 7.

A cyclone separator as an example of a dust separation device is shown in FIGS. 7 and 8. FIG. 8 shows the X—X cross-section of FIG. 7. The mixture of the dust and the gas flows through inlet 301, along a tangential direction, into the cyclone separator, whirls round along the wall of the cylindrical portion 303 to flow downward. In the conical portion 304, since the radius of whirling is reduced, the flow speed becomes greater and the downward flow with whirling is continued. During this operation, the dust having greater mass is expelled to the outer side of the whirling due to the centrifugal force, and flows along the wall of the cylindrical portion 303 and the conical portion 304 down to the dust collecting chamber 306 to be accumulated therein. However, the gas, which is of a small mass, upon reaching near the bottom of the conic portion, changes its flow to commence the upward flow to whirl in the central portion of the cyclone separator, passes the inner cylinder 305 on the side of the center of the cylindrical portion 303, and flows out from the cyclone separator through the outlet 302. Accordingly, the gas and the dust are separated from each other.

What is claimed is:

1. A vacuum pump apparatus with a dust collecting function comprising:

a vessel for processing which can be decompressed by a vacuum pump;

a suction piping connected to said processing vessel;

a vacuum pump operatively connected to said suction pump;

a vacuum pump piping adapted to constitute a main exhaust operation path including the vacuum pump for exhausting gas;

a gas discharge piping connected to said vacuum pump piping; and a dust separator connected directly to the vacuum pump in the main exhaust operation path;

an auxiliary circulation path including a shut-off valve;

wherein, during the period for exhaustion, an exhaust path is formed to allow exhaustion through the main exhaust operating path with the dust separator connected therein to be carried out, and, during the period in which the decompression by the vacuum pump is not necessary, the auxiliary circulation path is formed to constitute a circulation path together with the main exhaust operating path to carry out the collection of the dust.

2. A vacuum pump apparatus according to claim 1, wherein the dust separator is a cyclone type separation utilizing function of centrifugal force.

3. A vacuum pump apparatus according to claim 1, wherein a shut-off valve for opening and closing the auxiliary dust collecting circulation path is inserted in the dust collecting path.

4. A vacuum pump apparatus according to claim 1, wherein a liquid chamber for bubbling the gas is inserted in the gas discharge piping.

5. A vacuum pump apparatus according to claim 2, wherein a shut-off valve for opening and closing the auxiliary dust collecting circulation path is inserted in the dust collecting path.

6. A vacuum pump apparatus according to claim 2, wherein a liquid chamber for bubbling the gas is inserted in the gas discharge piping.

7. A vacuum pump apparatus according to claim 3, wherein a liquid chamber for bubbling the gas is inserted in the gas discharge piping.

* * * * *